US008330621B2

(12) United States Patent
Hayashi

(10) Patent No.: US 8,330,621 B2
(45) Date of Patent: Dec. 11, 2012

(54) IN-VEHICLE APPARATUS, ROADSIDE DEVICE, AND TRAFFIC INFORMATION SYSTEM

(75) Inventor: Hiroki Hayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 572 days.

(21) Appl. No.: 12/511,816

(22) Filed: Jul. 29, 2009

(65) Prior Publication Data

US 2010/0033347 A1 Feb. 11, 2010

(30) Foreign Application Priority Data

Aug. 7, 2008 (JP) ..... 2008-204316

(51) Int. Cl.
*G08G 1/09* (2006.01)

(52) U.S. Cl. ..... 340/905; 340/928

(58) Field of Classification Search ..... 340/902–905, 340/933, 928, 10.3; 701/2, 300
See application file for complete search history.

(56) References Cited

U.S. PATENT DOCUMENTS

| | | | | |
|---|---|---|---|---|
| 6,157,321 | A * | 12/2000 | Ricci | 340/902 |
| 6,249,232 | B1 * | 6/2001 | Tamura et al. | 340/902 |
| 7,286,040 | B2 * | 10/2007 | Karabinis | 340/10.1 |
| 2002/0036571 | A1 * | 3/2002 | Takahashi et al. | 340/901 |
| 2002/0167588 | A1 * | 11/2002 | Kamijo et al. | 348/135 |
| 2004/0122884 | A1 * | 6/2004 | Lee | 708/490 |
| 2005/0137782 | A1 * | 6/2005 | Shinada | 701/117 |
| 2010/0060433 | A1 * | 3/2010 | Karabinis | 340/10.3 |

FOREIGN PATENT DOCUMENTS

| | | |
|---|---|---|
| JP | 2002-198886 | 7/2002 |
| JP | 2002-373395 | 12/2002 |
| JP | 2005-182268 | 7/2005 |

* cited by examiner

*Primary Examiner* — Brent Swarthout
(74) *Attorney, Agent, or Firm* — Fujitsu Patent Center

(57) ABSTRACT

An in-vehicle apparatus includes a first receiver capable of receiving identification information about a vehicle group that is transmitted from a first roadside device in a signal having directivity; a judging unit for identifying a vehicle group to which a host vehicle of the in-vehicle apparatus belongs based on the identification information; and a first transmitter capable of transmitting the identification information to a second roadside device connected to a network of a road traffic system.

12 Claims, 16 Drawing Sheets

IN-VEHICLE APPARATUS, ROADSIDE DEVICE, AND TRAFFIC INFORMATION SYSTEM

CROSS-REFERENCE TO RELATED APPLICATIONS

This application is based upon and claims the benefit of priority of prior Japanese Patent Application No. 2008-204316, filed on Aug. 7, 2008, the entire contents of which are incorporated herein by reference.

FIELD

The embodiments of the present invention discussed herein are related to an in-vehicle apparatus, a roadside device, a traffic information system for use in an Intelligent Transport System (ITS), and to management of a vehicle group.

BACKGROUND

In recent years, ITS systems have been developed that are systems for networking humans, roads, and vehicles through information using information communication technology. There is especially a demand for a traffic information system that reduces traffic congestion and accidents and realizes safe and efficient driving by guiding the traveling of vehicles in accordance with traffic conditions on roads. In such a traffic information system, it is useful to perform definition and detection of a vehicle group, selection of a representative vehicle or the like as required, and technology for vehicle group management is required.

There are known vehicle travel guiding apparatuses that are equipped with vehicle group identifying means for judging whether a vehicle group has been formed or not based on the position and speed of vehicles traveling on a road (see Japanese Patent Laid-Open No. 2002-373395, for instance). Also, vehicle group formation systems are known in which a representative vehicle of a vehicle group communicates with a base station and delivers a request relating formation or dissolution of a vehicle group and the like received from the base station to other vehicles (see Japanese Patent Laid-Open No. 2002-198886, for instance).

A known technique using a vehicle travel guiding apparatus needs detection of position and/or speed of vehicles for identifying a vehicle group and requires installation of a detector for that purpose in each roadside device. Also, in the aforementioned vehicle group formation system, significant burden is placed on a network of the vehicle group formation system in individual phases, such as formation and dissolution of a vehicle group, because vehicle group management is carried entirely out at a high level of the network.

SUMMARY

According to an aspect of the invention, an object is to enable simpler management of a vehicle group.

According to an aspect of the invention, an in-vehicle apparatus includes a first receiver capable of receiving identification information about a vehicle group that is transmitted from a first roadside device in a signal having directivity, a judging unit for identifying a vehicle group to which a host vehicle of the judging unit belongs based on the identification information, and a first transmitter capable of transmitting the identification information to a second roadside device connected to a network of a road traffic system. A roadside device as described herein includes a storage unit for storing identification information for a vehicle to identify a vehicle group to which the vehicle belongs, and a transmitter for transmitting the identification information to the vehicle in a signal having directivity.

The traffic information system may include the in-vehicle apparatus, the first roadside device, and the second roadside device described above.

It is to be understood that both the foregoing general description and the following detailed description are exemplary and explanatory and are not restrictive of the invention, as claimed.

DESCRIPTION OF EMBODIMENTS

Preferred embodiments of the present invention are explained.

First Embodiment

Figure 1:
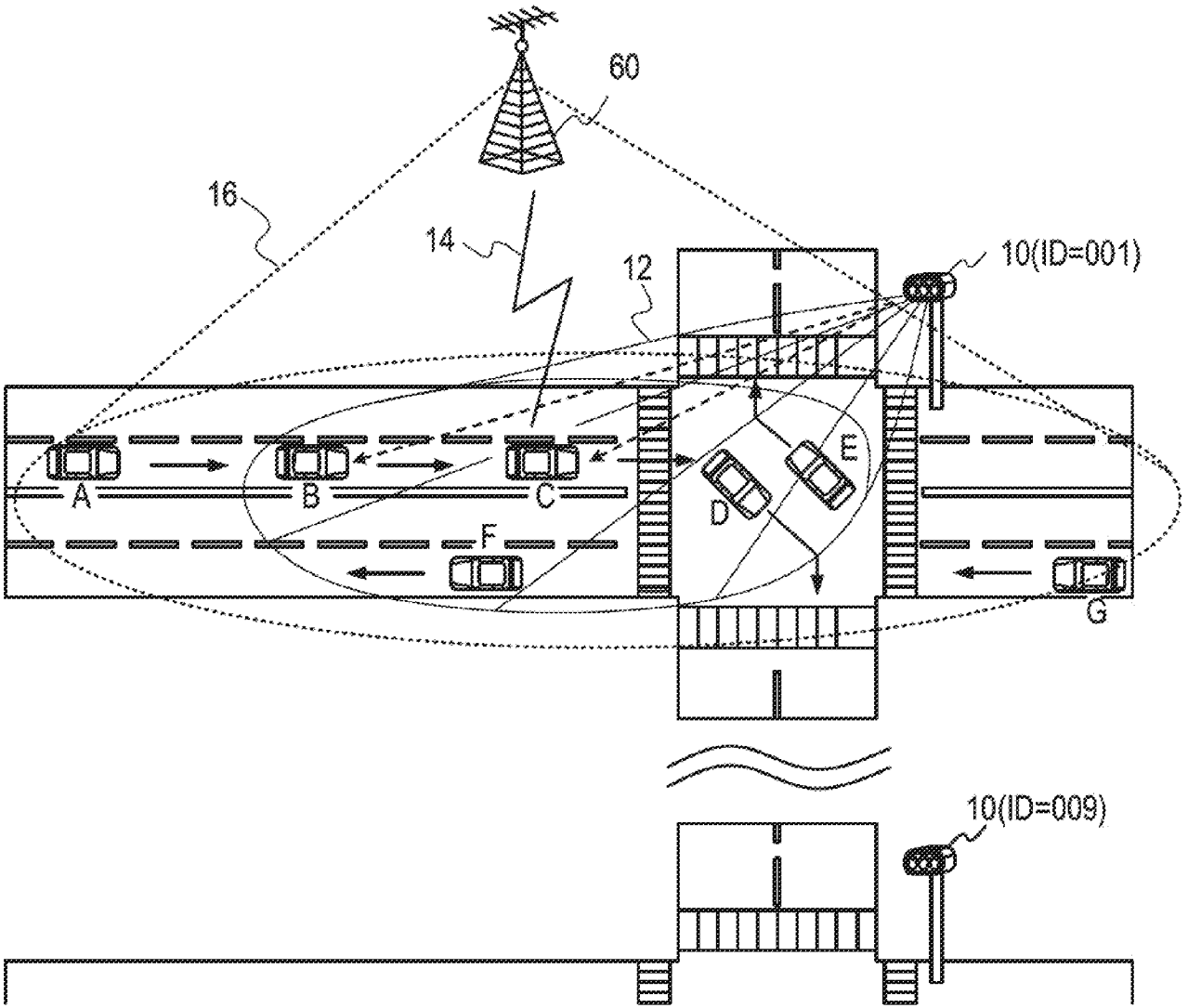
FIG. 1 is an example of a configuration of a traffic information system according to a first embodiment.

FIG. 1 is a schematic diagram of a traffic information system according to a first embodiment. The traffic information system includes an optical communication device (a first roadside device) installed on a traffic light 10 at a roadside, an ITS roadside device 60 (a second roadside device) which is connected to a network of an ITS system (a road traffic system), and in-vehicle apparatuses mounted in vehicles A to E that are traveling. In the figure, the traveling direction of a vehicle is denoted by an arrow.

The traffic light 10 has a function of transmitting an optical signal containing a vehicle group ID, which is discussed later, to vehicles that are traveling within a specific zone. An area 12 in the figure represents a coverage area of an optical signal. An optical signal transmitted from the traffic light 10 has directivity so that vehicles B and C that are pointing in the direction the traffic light 10 receive the optical signal among vehicles B to F that are present in the area 12.

The traveling vehicles A to E transmit and receive information to and from the ITS roadside device 60 via wireless communication (reference numeral 14). An area 16 in which signals can be communicated between the ITS roadside device 60 and vehicles is illustrated in the figure by a dotted line. An ITS signal coverage area 16 is larger than an optical signal coverage area 12. For example, the ITS signal coverage area 16 may include multiple optical signal coverage areas 12.

Figure 2:
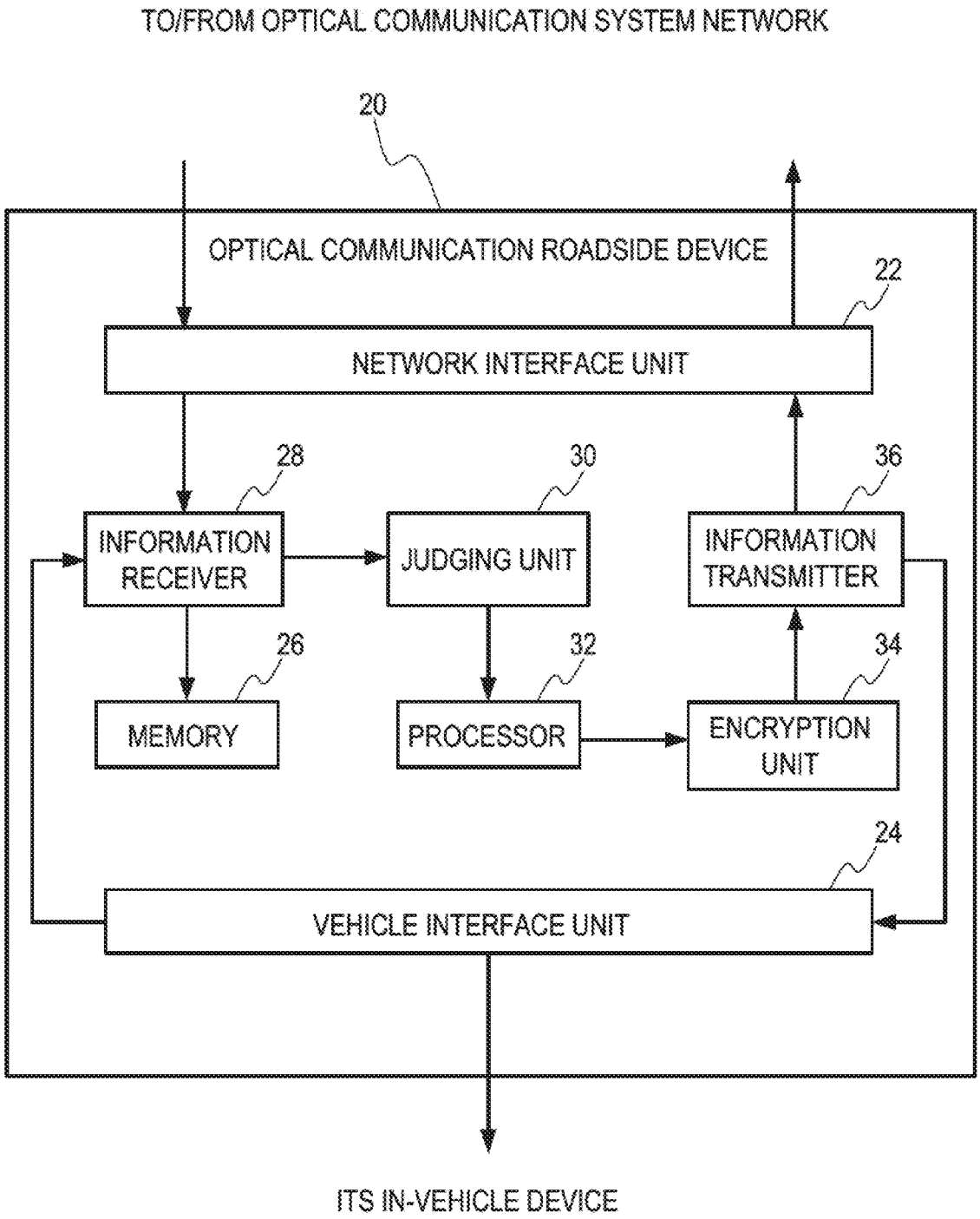
FIG. 2 is a block diagram illustrating an example of a configuration of an optical communication roadside device of FIG. 1.

Now, a detailed configuration of the information system according to the present embodiment will be described. FIG. 2 is an example of configuration of the optical communication roadside device 20 installed on the traffic light 10 of FIG. 1. The optical communication roadside device 20 includes a network interface unit 22 as an interface unit for interfacing with an optical communication system network, a vehicle interface unit 24 as an interface with an ITS in-vehicle apparatus mounted in a vehicle, memory 26, an information receiver 28, a judging unit 30, a processor 32, an encryption unit 34, and an information transmitter 36. The judging unit 30, processor 32, and encryption unit 34 may be realized by causing a CPU to execute a program stored in memory, for example.

The information receiver 28 obtains setting information for setting a vehicle group ID from the network of the optical communication system via the network interface unit 22. The network of the optical communication system may be constructed independently of the network of the ITS system. Here, a vehicle group refers to a set of traveling vehicles (e.g., several to a dozen or so vehicles) and it is assumed that vehicles belonging to the same vehicle group are traveling with relatively short intervals between the other vehicles in the group. A vehicle group ID is information used for identifying a vehicle group in the traffic information system of the present embodiment. In the present embodiment, the optical communication roadside device 20 is installed on the traffic light 10, and a vehicle group ID is set for each optical communication roadside device 20 located at each intersection. The vehicle group ID to be set may be different for each intersection or the same for a certain zone (e.g., a unit such as city, ward, town, or village). The memory 26 stores vehicle group IDs obtained by the network interface unit 22.

The information transmitter 36, as a transmitter, sends an optical signal containing a vehicle group ID to vehicles via the vehicle interface unit 24. The vehicle group ID may be transmitted by modulating optical signal based on the group ID information bits. The coverage area and direction of an optical signal is limited to a predetermined range in advance. This prevents assignment of a vehicle group ID to a vehicle that is outside the optical signal coverage area 12. While the present embodiment is described with a case where a vehicle group ID is transmitted in an optical signal, the signal for transmitting a vehicle group ID may be of other forms as long as the signal has directivity (or rectilinearity) and allows designation of a certain range as a coverage area. Visible light, infrared or the like may be used for an optical signal, but millimeter wave, which has a longer wavelength, may also be used.

When the optical communication roadside device 20 is installed on the traffic light 10 as in the present embodiment, a part of the configuration of the traffic light 10 may be utilized as a part of the vehicle interface unit 24. For example, an LED of a traffic light may be used as a light emitting unit for optical signal generation. In such a case, installation costs may be reduced because only a modulation mechanism or the like may be added to existing equipment. The optical communication roadside device 20 may also be installed on a road sign or an electronic signboard for directions.

Figure 3:
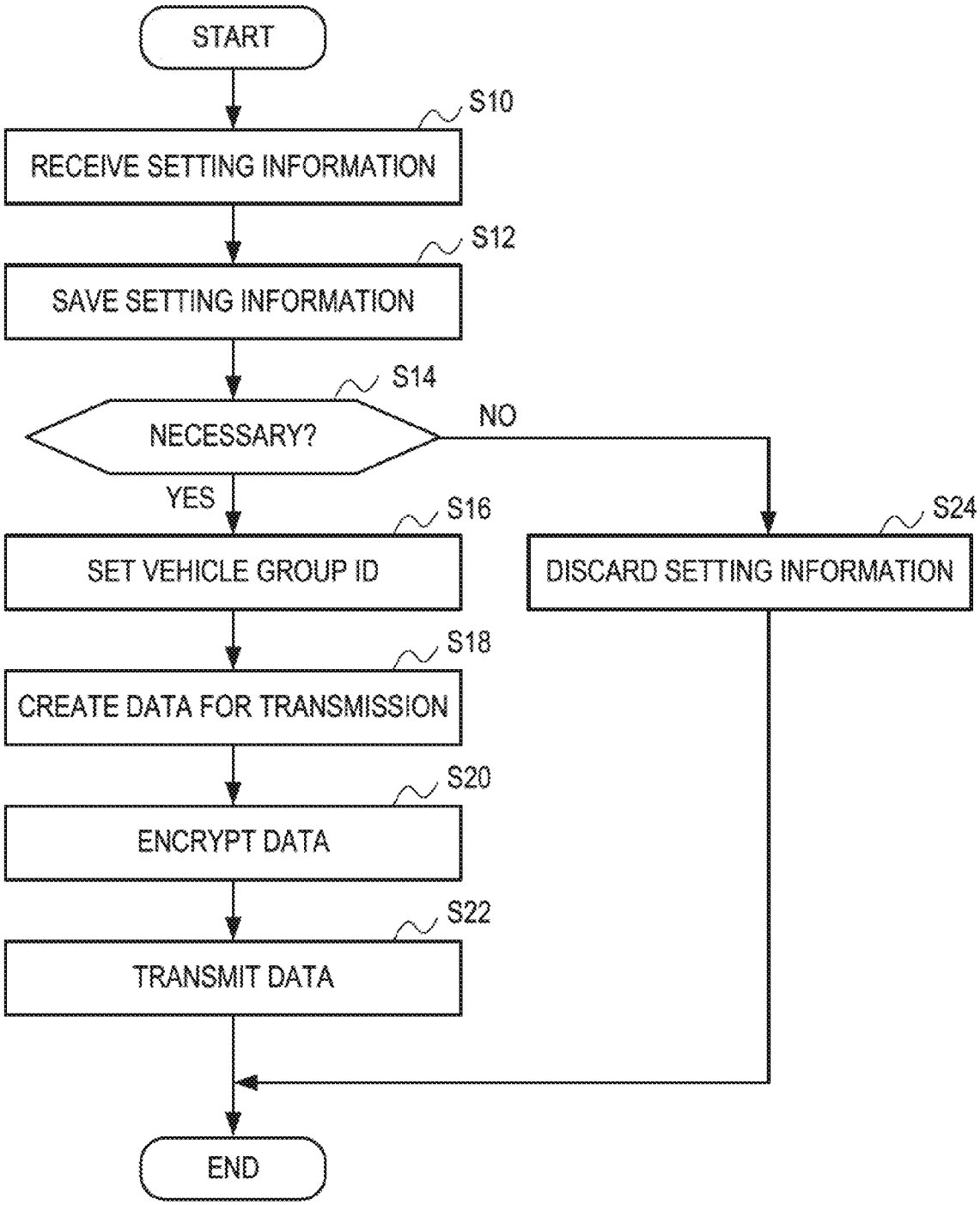
FIG. 3 is a flowchart illustrating an example of control flow by the optical communication roadside device of FIG. 2.

FIG. 3 is a flowchart illustrating operations of the optical communication roadside device 20 described above. First, the information receiver 28 obtains setting information for setting a vehicle group ID via the network interface unit 22 (step S10). Next, the memory 26 stores the setting information obtained by the information receiver 28 (step S12). Alternatively, the setting information may be prestored in the memory 26 without performing steps S10 and S12.

Then, the judging unit 30 verifies the setting information obtained by the information receiver 28 (step S14). If it is determined at step S14 that the setting information is necessary, the judging unit 30 sets a vehicle group ID for the optical communication roadside device 20 based on the setting information (step S16). Next, the processor 32 creates data for transmission containing the vehicle group ID (step S18). Then, the encryption unit 34 encrypts the generated data for transmission (step S20). The information transmitter 36 transmits the encrypted data to vehicles via the vehicle interface unit 24 (step S22). If it is determined at step S14 that the setting information is not necessary, the setting information is discarded (step S24).

Figure 4:
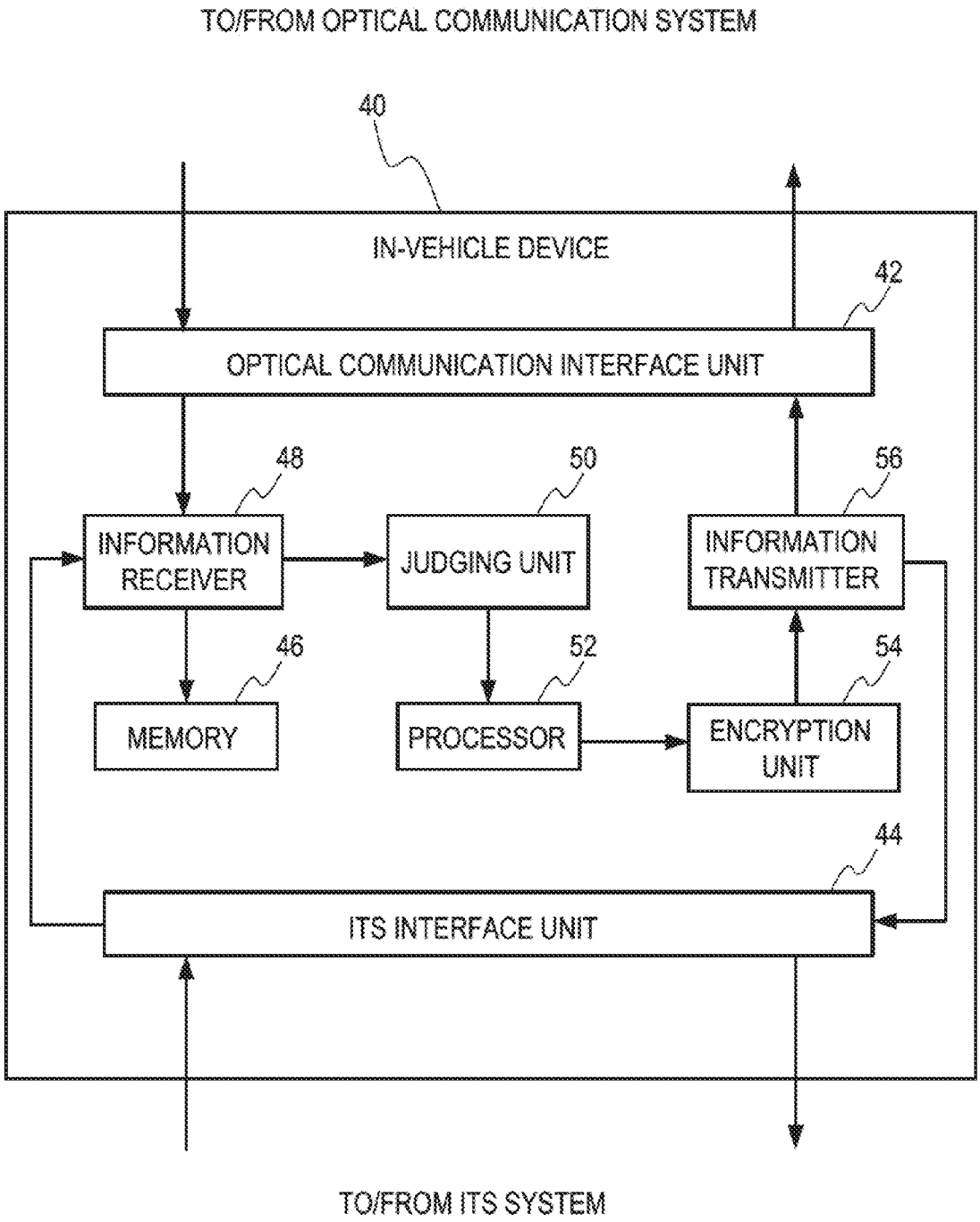
FIG. 4 is an example of the configuration of an in-vehicle device of FIG. 1.

An in-vehicle apparatus (or an in-vehicle device), which is mounted in a vehicle in the traffic information system of the present embodiment, will be now described. FIG. 4 is an example of a configuration of the in-vehicle device 40 mounted in the vehicles A to E of FIG. 1. The in-vehicle device 40 includes an optical communication interface unit 42 which is an interface unit for interfacing with the optical communication system, an ITS interface unit 44 as an interfacing unit for interfacing with the ITS system, memory 46, an information receiver 48 as first and second receivers, a judging unit 50 as a judging unit, a processor 52, an encryption unit 54, and an information transmitter 56 as first and second transmitters.

The optical communication interface unit 42 includes a light receiving unit for receiving an optical signal transmitted from the optical communication roadside device 20 of FIG. 2 and a light emitting unit for transmitting an optical signal rearward of the vehicle. The information receiver 48 obtains an optical signal containing a vehicle group ID from the optical communication roadside device 20 via the light receiving unit of the optical communication interface unit 42. Here, the information receiver 48 preferably has a function of recognizing the direction of a received signal in addition to the signal receiving function. Alternatively, it is preferable that the in-vehicle device be installed such that the light receiving unit of the optical communication interface unit 42 points in a predetermined direction. Thereby, the reception range of an optical signal may be limited so that only an optical signal necessary for acquisition of a vehicle group ID can be received. The reception range of an optical signal may be set to a zone within a predetermined angle with the traveling direction of the vehicle as the center, for example.

The information transmitter 56 transmits an optical signal containing a vehicle group ID rearward of the vehicle via the light emitting unit of the optical communication interface unit 42. Light transmitted by the light emitting unit is received by the light receiving unit of the optical communication interface unit 42 of the in-vehicle device 40 of a vehicle behind. That is to say, in the present embodiment, the information receiver 48 may receive an optical signal from a vehicle ahead.

The ITS interface unit 44 includes a wireless communication unit for communicating with the ITS roadside device 60 of FIG. 1. The information receiver 48 and the information transmitter 56 exchange information with the ITS roadside device 60 via wireless communication. Non-directivity may be applied to communication with the ITS roadside device 60 and a radio wave of a longer wavelength than that of light or millimeter wave may be used. Information received from the ITS roadside device 60 includes various types of traffic information, such as information on traffic congestion or accidents. Information transmitted to the ITS roadside device 60 includes various information about the vehicle (such as position and speed of the vehicle, and/or meteorological information such as ambient temperature, humidity, and weather, which are hereinafter called "probe information"), in addition to the vehicle group ID mentioned above.

Figure 5:
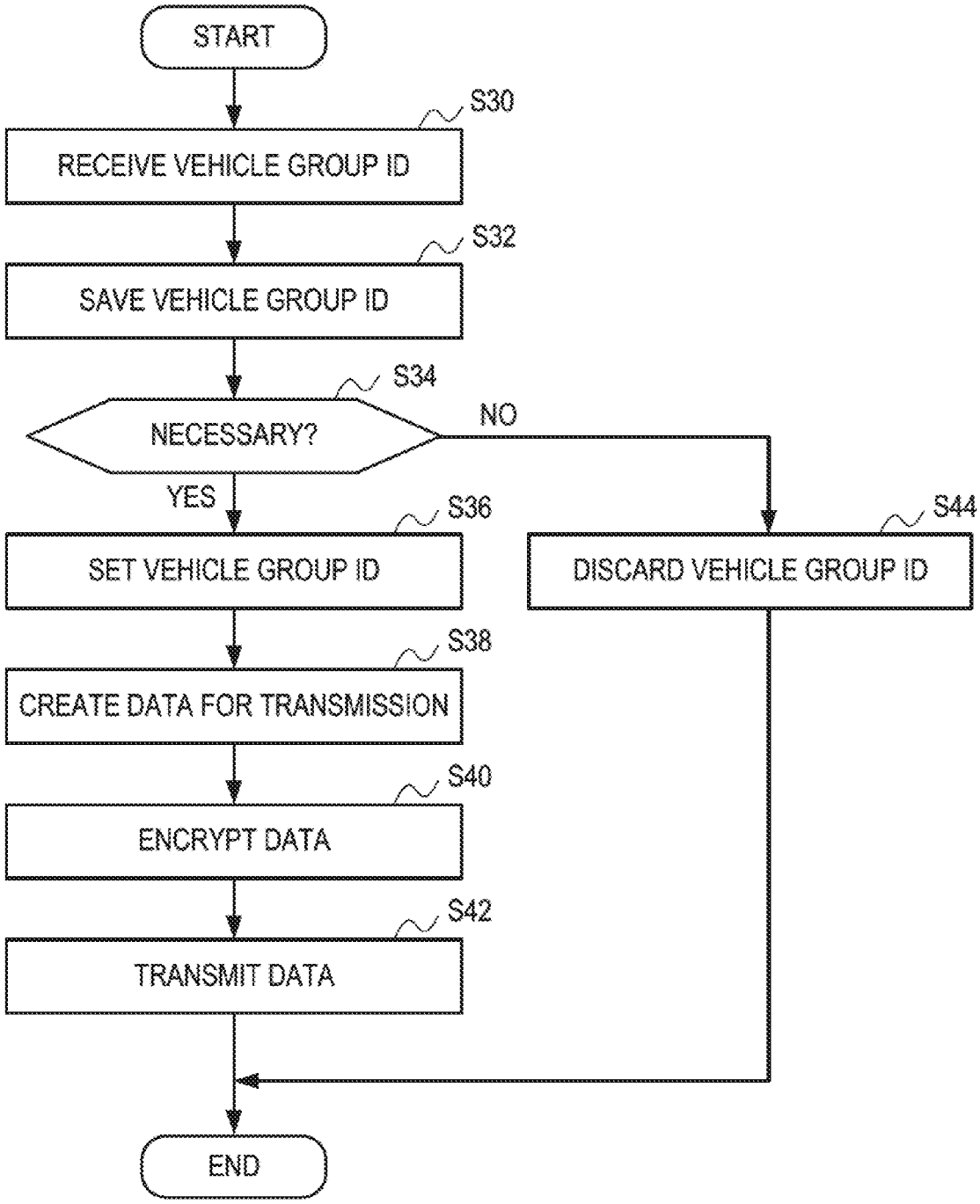
FIG. 5 is a flowchart illustrating an example of control flow by the in-vehicle device of FIG. 4.

FIG. 5 is a flowchart illustrating operations relating to transmission and reception of a vehicle group ID among operations of the in-vehicle device 40 described above. Exchange of probe information, traffic information and the like will be discussed later. First, the information receiver 48 obtains a vehicle group ID via the optical communication interface unit 42 (step S30). A vehicle group ID may be received from either the optical communication roadside device 20 or a vehicle ahead as mentioned above, the source is not questioned here. Next, the memory 46 stores the vehicle group ID obtained by the information receiver 48 (step S32).

Then, the judging unit 50 verifies the vehicle group ID obtained by the information receiver 48 (step S34). If it is determined at step S34 that the vehicle group ID is necessary, the judging unit 50 sets an attribute of the vehicle based on the vehicle group ID (step S36). That is to say, the judging unit 50 judges that the vehicle belongs to a vehicle group having a certain vehicle group ID (e.g., an ID "001"). Next, the processor 52 creates data for transmission containing the vehicle group ID based on the setting information (step S38). Next, the encryption unit 54 encrypts the generated data for transmission (step S40). The information transmitter 56 transmits the encrypted data to the ITS roadside device 60 via the ITS interface unit 44 (step S42). If it is determined at step S34 that the vehicle group ID is not necessary, the vehicle group ID is discarded (step S44).

Figure 6:
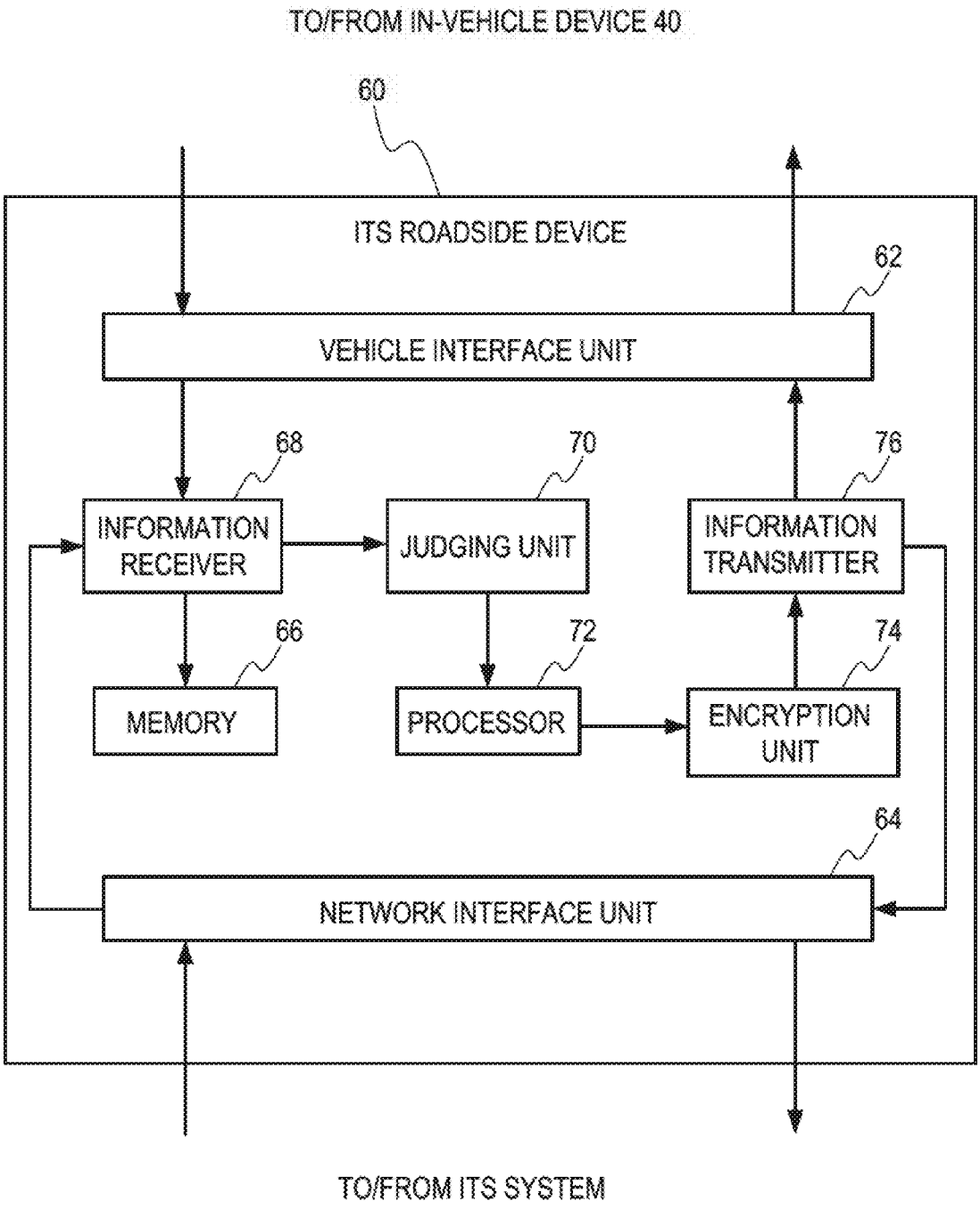
FIG. 6 is an example of the configuration of an ITS roadside device of FIG. 1.

The ITS roadside device 60 of FIG. 1 will be now described in greater detail. FIG. 6 is an example of a configuration of the ITS roadside device 60. The ITS roadside device 60 includes a vehicle interface unit 62 as an interface unit for interfacing with the in-vehicle device 40 of FIG. 4, a network interface unit 64 as an interface unit for interfacing with the network of the ITS system, memory 66, an information receiver 68, a judging unit 70, a processor 72, an encryption unit 74, and an information transmitter 76.

The information receiver 68 receives a vehicle group ID and probe information via the vehicle interface unit 62 and also receives various types of information from a center server or the like of the ITS system network via the network interface unit 64. Information received by the information receiver 68 from the ITS system network includes various sorts of traffic information and facility information for a range covered by the ITS roadside device 60.

The information transmitter 76 transmits to vehicles various types of information received by the information receiver 68 from the ITS system network. The information transmitter 76 also transmits probe information collected from vehicles to the center server or the like of the ITS system network via the network interface unit 64.

Figure 7:
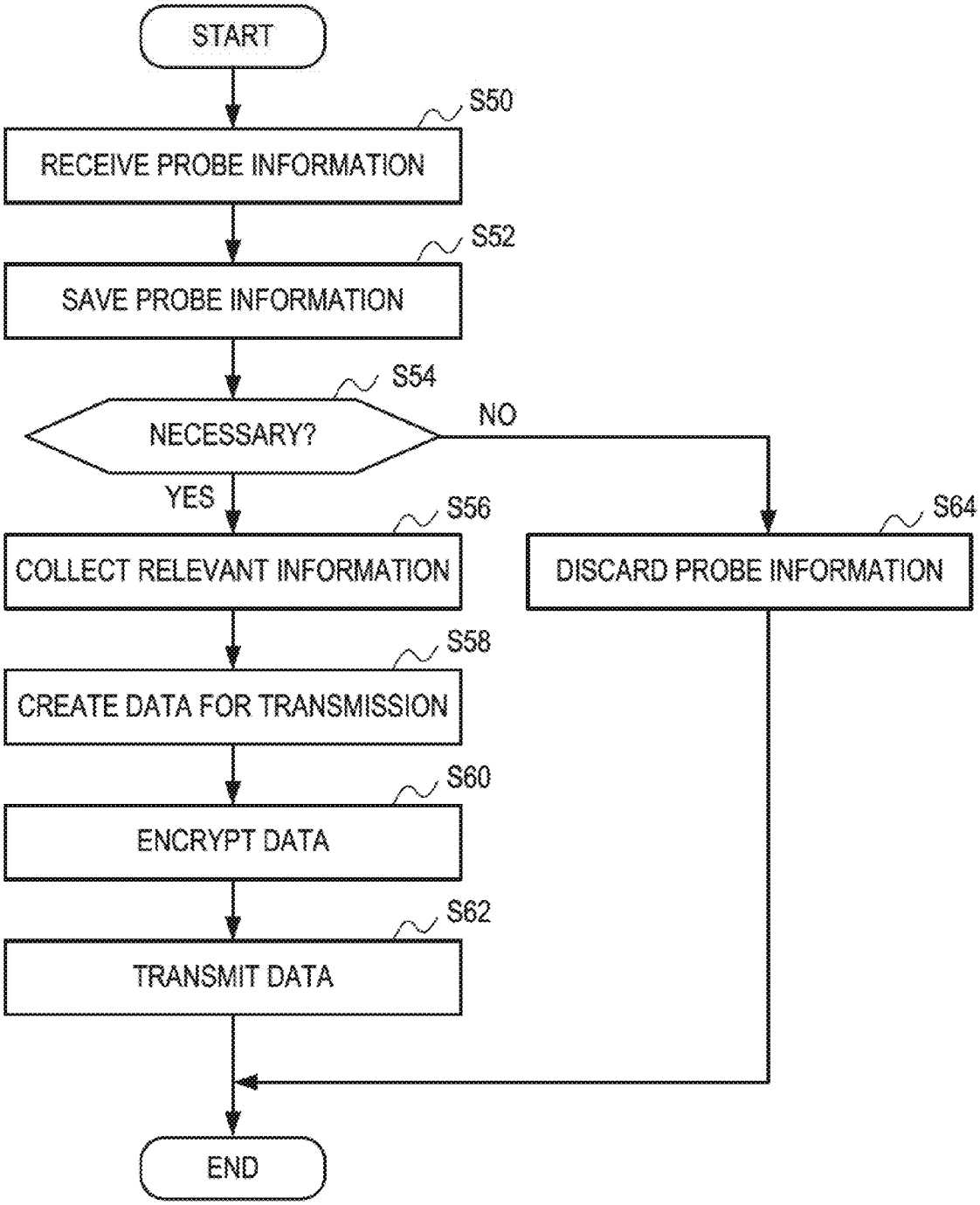
FIG. 7 is a flowchart illustrating an example of control flow by the ITS roadside device of FIG. 6.

FIG. 7 is a flowchart illustrating operations relating to a vehicle group ID among operations of the ITS roadside device 60 described above. First, the information receiver 68 obtains a vehicle group ID via the vehicle interface unit 62 (step S50). Next, the memory 66 stores the vehicle group ID obtained by the information receiver 68 (step S52).

Then, the judging unit 70 verifies the vehicle group ID obtained by the information receiver 68 (step S54). If it is determined at step S54 that the vehicle group ID is necessary, the processor 72 collects various types of information (e.g., traffic or facility information) based on the vehicle group ID (step S56) and creates data for transmission (step S58). At this point, each piece of data for transmission is associated with the vehicle group ID by the processor 72. Then, the encryption unit 74 encrypts the generated data for transmission (step S60). The information transmitter 76 transmits the encrypted data to vehicles via the vehicle interface unit 62 (step S62). If it is determined at step S54 that the vehicle group ID is not necessary, the vehicle group ID is discarded (step S64).

As described above, a vehicle group ID is set for each vehicle by the optical communication roadside device 20 and the in-vehicle device 40 to form a vehicle group. In addition, by transmitting the vehicle group ID that has been set from the in-vehicle device 40 to the ITS roadside device 60, a vehicle group may be recognized on the ITS system side.

Figure 8:
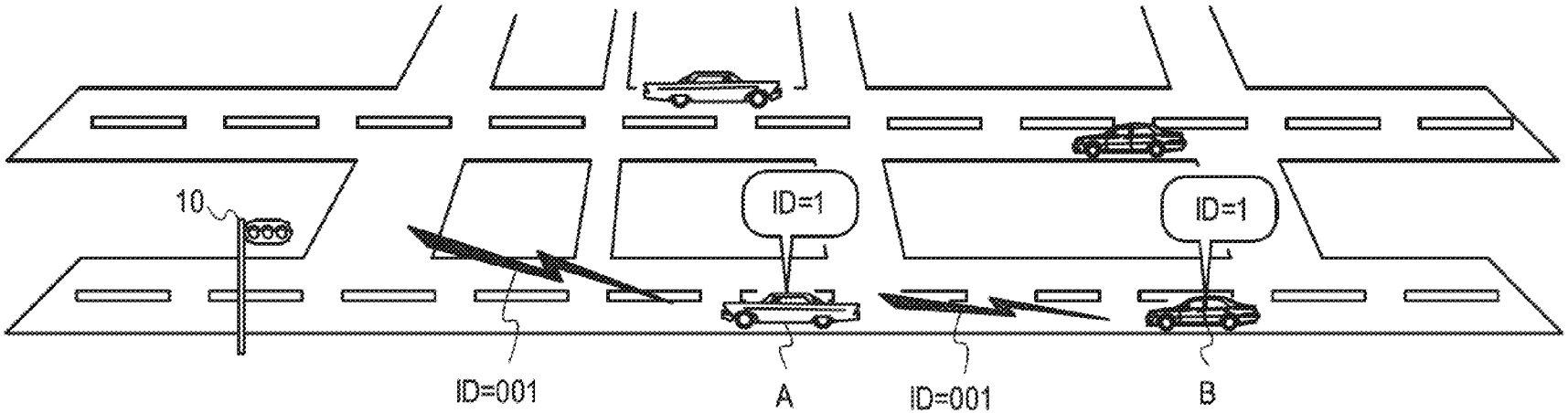
FIG. 8 is an example of information flow in the traffic information system according to the first embodiment.

FIG. 8 is a diagram for illustrating control relating to definition of a vehicle group in the traffic information system according to the present embodiment. To the vehicle A positioned at the head of a vehicle group, an optical signal containing a vehicle group ID "001" is transmitted from the traffic light 10 which is positioned in the traveling direction of the vehicle A. The vehicle A receives the optical signal from the traffic light 10 and recognizes that vehicle A belongs to the vehicle group ID "001". The vehicle A transmits an optical signal containing the vehicle group ID "001" from a light emitting unit provided at a rear position (the optical communication system interface unit 42 of FIG. 4) in a rearward direction. The vehicle B which is positioned behind the vehicle A receives the optical signal from the vehicle A and recognizes that vehicle B belongs to the vehicle group ID "001" which is the same as the vehicle A. At this point, since the vehicle B is at some distance from the traffic light 10, it does not directly receive the optical signal from the traffic light 10 but receives the vehicle group ID "001" via the vehicle A. As described above, a number of vehicles driving in the same direction at certain intervals are defined as a vehicle group and may be managed with one vehicle group ID.

According to the traffic information system of the first embodiment, an optical signal containing a vehicle group ID is transmitted from the optical communication roadside device 20 to vehicles (step S22 of FIG. 3), and the in-vehicle device 40 mounted in each vehicle receives the vehicle group ID (step S30 of FIG. 5) and sets the received vehicle group ID as the vehicle group to which that vehicle belongs, thereby defining a vehicle group. By using the vehicle group ID in this way, a vehicle group may be managed more simply than in a conventional system. In addition, burden on the ITS system may be reduced by judging whether a vehicle group has been formed using an optical communication system that is independent of the ITS system.

The present embodiment uses an optical signal for assigning a vehicle group ID to vehicles. Advantages of using an optical signal include the following. Because light has directivity (or rectilinearity), a signal may be transmitted within a limited range as compared with radio wave having a longer wavelength than that of light. This enables fine setting of which vehicle group ID should be obtained by a traveling vehicle.

Whether a vehicle receives an optical signal or not is determined by the positional relation between the direction of light emitted from the optical communication roadside device 20 and a light receiving sensor mounted on the vehicle (corresponding to the optical communication interface unit 42 of the in-vehicle device 40). Describing this with reference to FIG. 1, for example, an optical signal is transmitted from the traffic light 10 toward the area 12. Therefore, vehicles A and G which are outside the area 12 do not receive the optical signal. Vehicles D, E and F that are not pointing in the direction of the traffic light 10 also do not receive the optical signal even through they are positioned in the area 12. As a result, it is possible to allow only vehicles B and C which are traveling straight toward the traffic light 10 to obtain the optical signal (or a vehicle group ID).

Optical signals also have advantages of being usable in various environments, such as inside a tunnel, and having little effect on other electric devices mounted in a vehicle. Millimeter wave of a longer wavelength may also be employed as mentioned above for a signal carrying unit that provides equivalent effects.

Second Embodiment

A second embodiment is an example where information transmitted from an ITS roadside device is sorted out using a vehicle group ID. The configuration of the traffic information system according to the second embodiment is the same as that illustrated in FIG. 1 of the first embodiment and configurations of the individual devices are also common. In the second embodiment, the judging unit 50 of the in-vehicle device 40 functions as a selection unit for selecting information.

Figure 9:
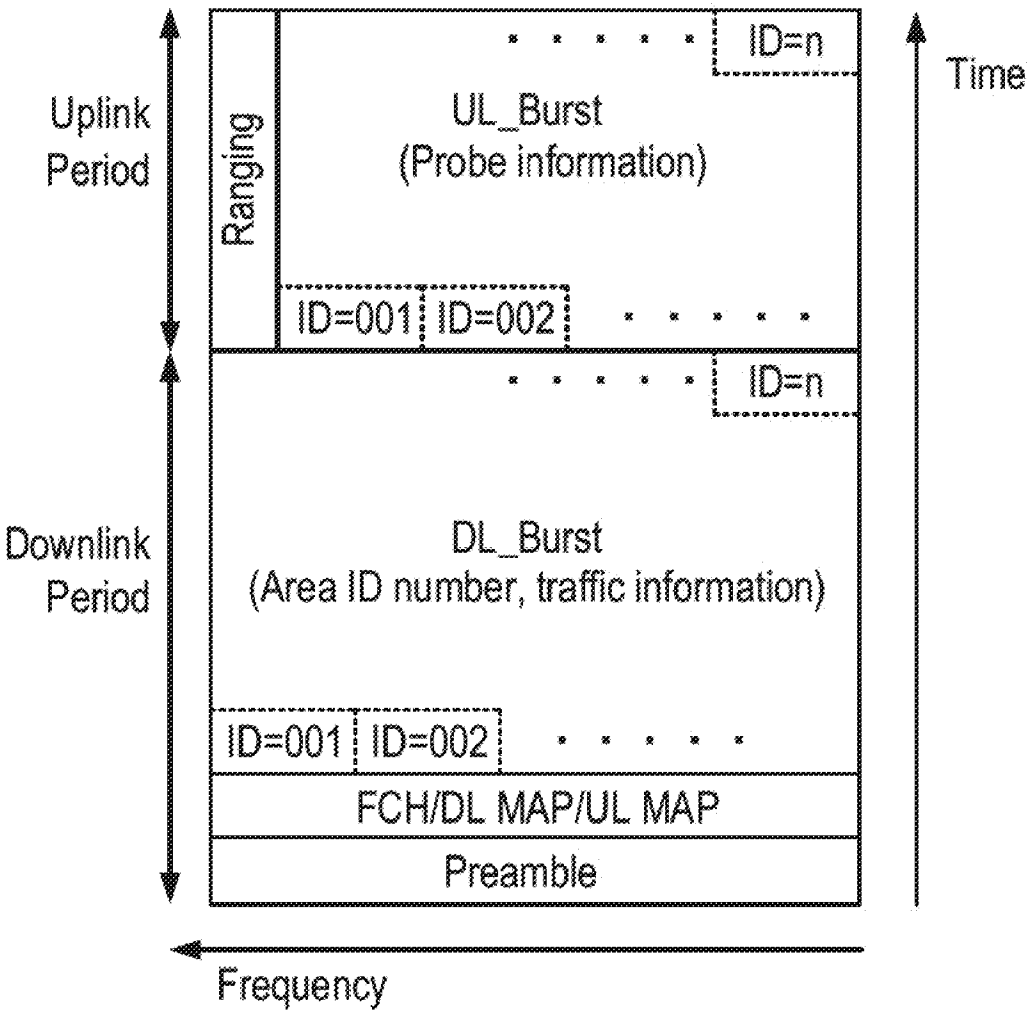
FIG. 9 is an example of a format for a signal that is transmitted and received between the ITS roadside devices according to a second embodiment and a vehicle.

FIG. 9 illustrates an example of a signal format for information exchanged between the ITS roadside device 60 of FIG. 6 and vehicles. The horizontal axis represents time and the longitudinal axis represents signal frequency. Information transmission from the ITS roadside device 60 to a vehicle is defined as "downlink," and information transmission from a vehicle to the ITS roadside device is defined as "uplink." As illustrated, information received in a downlink period includes ID numbers (or vehicle group IDs) of multiple areas in addition to traffic information. As downlink information, the same information is delivered to an area covered by the ITS roadside device 60 by broadcasting rather than a separate piece of information being transmitted to each vehicle.

Figure 10:
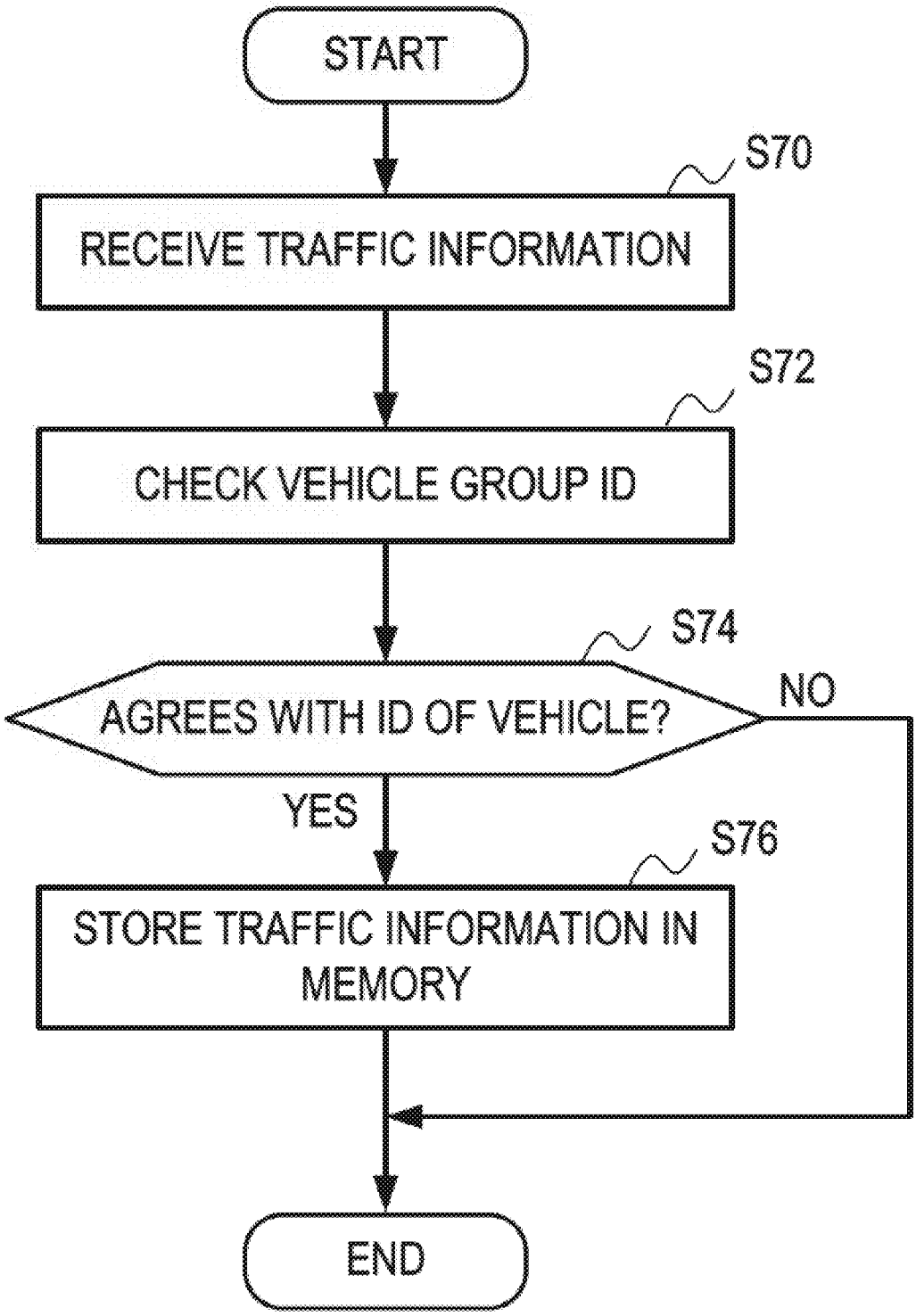
FIG. 10 is a flowchart illustrating an example of control flow by the traffic information system according to the second embodiment.

FIG. 10 is an example of a flow of control by the traffic information system according to the second embodiment. In FIGS. 4 and 10, the information receiver 48 of the in-vehicle device 40 first receives traffic information from the ITS roadside device 60 (step S70). Next, the judging unit 50 checks a vehicle group ID contained in the received information against the vehicle group ID of its host vehicle (step S72). The judging unit 50 judges whether the ID associated with the received information agrees with the vehicle group ID of the host vehicle or not (step S74), and if the IDs agree with each other, stores the information in the memory 46 (step S76).

As described above, the in-vehicle device 40 of the second embodiment has a selection unit for selecting relevant information based on a vehicle group ID from information received by the information receiver 48. According to this configuration, a vehicle may obtain only information that is relevant to the area in which the vehicle is traveling from traffic information delivered by broadcasting across a wide range from the ITS roadside device 60. This enables the ITS roadside device 60 to deliver information to vehicles in its area by broadcasting without having to transmit information separately to those vehicles. As a result, bandwidth used for downlink may be reduced.

Third Embodiment

A third embodiment is an example where a representative vehicle in a vehicle group and dependent vehicles that are placed under the vehicle are selected. The configurations of the traffic information system according to the third embodiment and individual devices are the same as in the first embodiment and hence detailed description thereof is omitted. In the third embodiment, the judging unit 50 of the in-vehicle device 40 has a function of distinguishing a signal transmitted from the optical communication roadside device 20 from a signal transmitted from a vehicle ahead.

Figure 11:
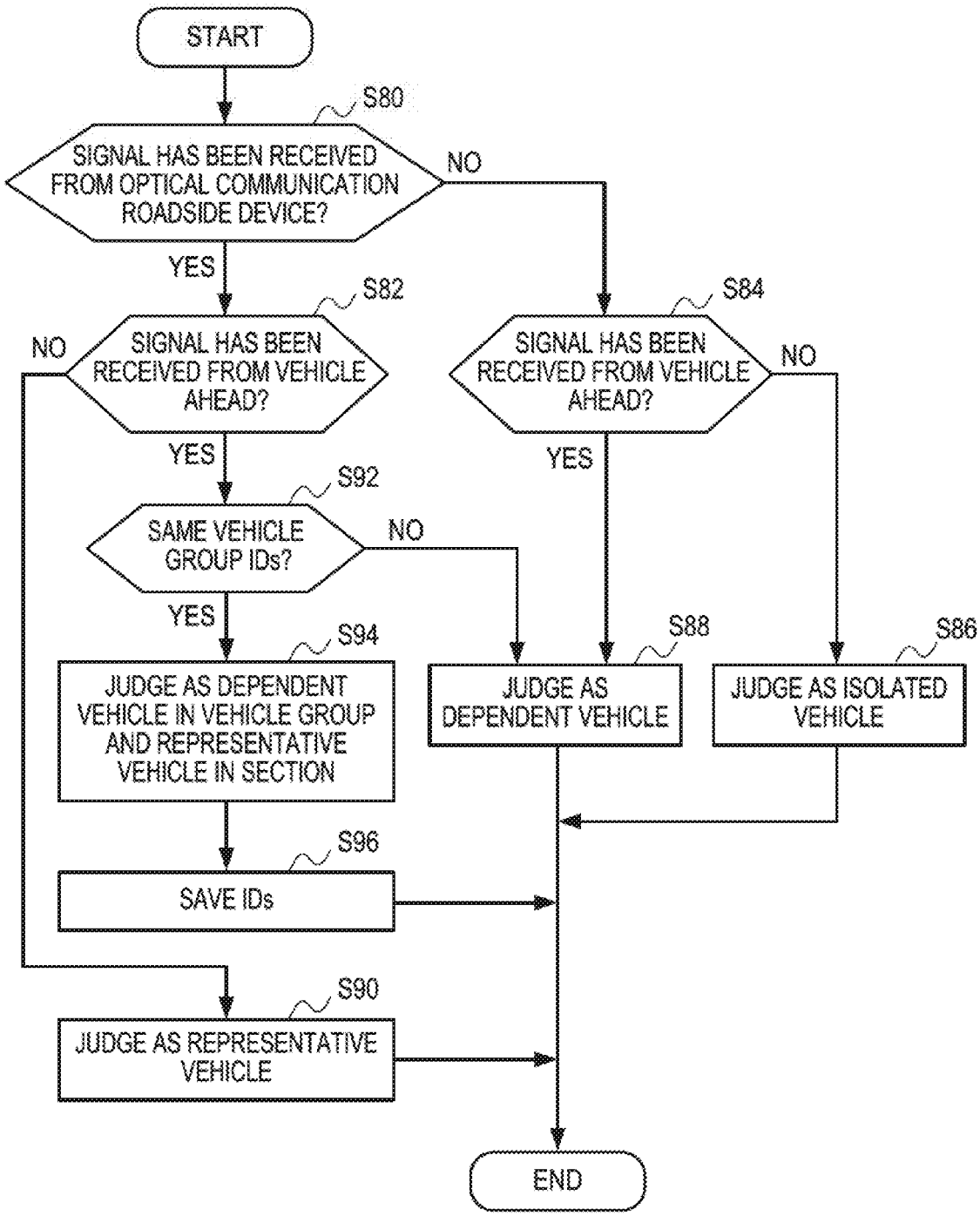
FIG. 11 is a flowchart illustrating an example of control flow by the traffic information system according to a third embodiment.

FIG. 11 is an example of a flow of control by the traffic information system according to the third embodiment. First, the judging unit 50 of the in-vehicle device 40 judges whether an optical signal has been received from the optical communication roadside device 20 or not (step S80), and then judges whether an optical signal has been received from the vehicle ahead or not (steps S82 and S84). If the judgment results in NO at both steps S80 and S84, the in-vehicle device 40 does not receive an optical signal either from the optical communication roadside device 20 nor from a vehicle ahead, thus the judging unit 50 judges that the host vehicle thereof is an isolated vehicle that belongs to no vehicle group (step S86).

If the judgment results in NO at step S80 and YES at step S84, the in-vehicle device 40 does not receive the optical signal from the optical communication roadside device 20 and receives only the optical signal from the vehicle ahead, thus the judging unit 50 judges that the vehicle is a dependent vehicle in a vehicle group (step S88).

If the judgment results in YES at step S80 and NO at step S82, the in-vehicle device 40 does not receive the optical signal from the vehicle ahead and receives only the optical signal from the optical communication roadside device 20. Thus, the judging unit 50 judges that the vehicle is a representative vehicle of a vehicle group (i.e., a vehicle that is positioned at the head of a vehicle group) (step S90).

If judgment results in YES both at steps S80 and S82, that is, if the in-vehicle device 40 receives two types of optical signal, the attribute of the vehicle is further identified by comparing the vehicle group IDs contained in the optical signals with each other. To be specific, a vehicle group ID contained in the optical signal from the optical communication roadside device 20 is defined as a first vehicle group ID and a vehicle group ID contained in the optical signal from the vehicle ahead is defined as a second vehicle group ID, and if the two vehicle group IDs are the same, the judging unit 50 judges that the vehicle is a dependent vehicle in a vehicle group (step S88).

If the first and second vehicle group IDs are different, the judging unit 50 judges that the vehicle is a dependent vehicle in a vehicle group and is a representative vehicle in a predetermined section defined by the optical communication roadside device 20 (step S92). In this case, the memory 46 of the in-vehicle device 40 saves both the first and second vehicle group IDs.

Figure 12:
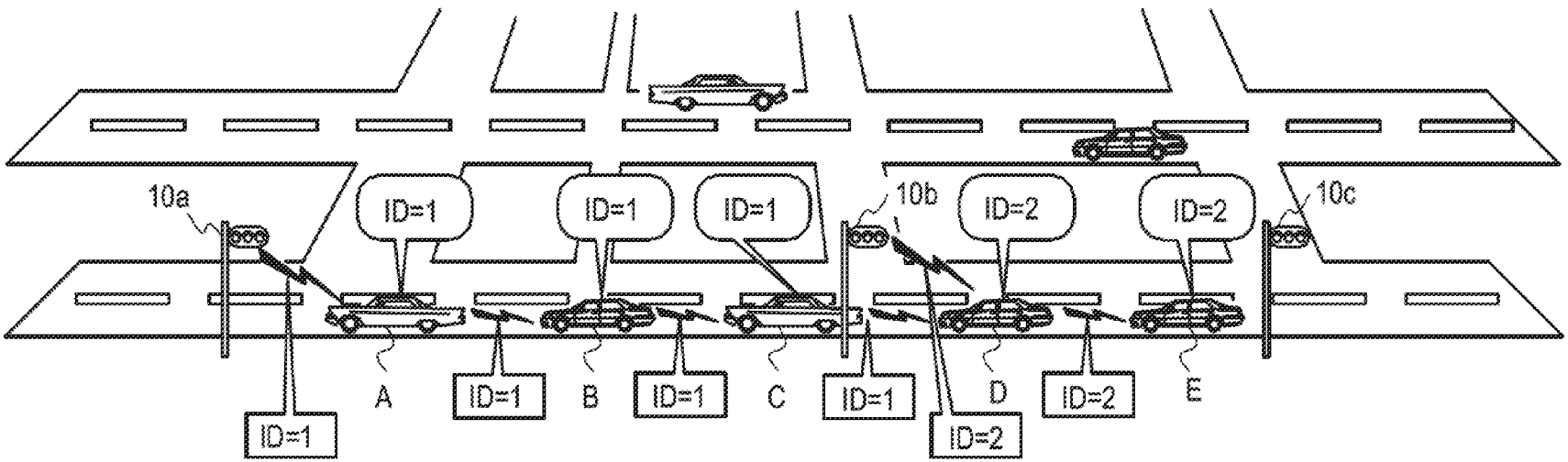
FIG. 12 is a diagram (1) illustrating an example of information flow in the traffic information system according to the third embodiment.

FIG. 12 is a schematic diagram for illustrating attributes of vehicles in the third embodiment. The vehicle A which is positioned at the head of a vehicle group is identified as the representative vehicle of the vehicle group because the vehicle A receives only ID "1" from the traffic light 10*a*. Vehicles B and C, which are positioned behind the vehicle A, are identified as dependent vehicles in the vehicle group because they receive only ID "1" from vehicles A and B which are positioned ahead of them, respectively. In this case, vehicles B and C are identified as dependent vehicles also in the section between the traffic lights 10*a* and 10*b*.

The vehicle D positioned behind the vehicle C receives both the signal containing ID "1" sent from a rear portion of the vehicle C and the signal containing ID "2" sent from the traffic light 10*b*. Here, since the vehicle group IDs contained in the two signals are different, the vehicle D is identified as a dependent vehicle of vehicle A in the vehicle group and as a representative vehicle in the section between the traffic lights 10*b* and 10*c*. The vehicle E, which is positioned behind the vehicle D, receives only ID "2" from the vehicle D which is positioned ahead of vehicle E and hence is identified as a dependent vehicle like vehicles B and C.

As described above, in the traffic information system of the third embodiment, a vehicle determines its attributes within a vehicle group based on two types of signal, i.e., a signal transmitted from the optical communication roadside device 20 and one transmitted from a vehicle ahead. According to the present configuration, it is possible to select representative and dependent vehicles in a simple way using an optical communication system which is independent of the ITS system and vehicle group IDs. In addition, because selection of representative and dependent vehicles does not have to be performed on the ITS system side, burden on the network of the ITS system may be reduced.

In the third embodiment, the judging unit 50 recognizes signals sent from the optical communication roadside device 20 and the vehicle ahead based on the direction of an optical signal incident to the light receiving unit of the optical communication interface unit 42, for example. Alternatively, the processor 52 of the in-vehicle device 40 may attach a predetermined flag (or identification information) to a vehicle group ID to be transmitted from the information transmitter 56 for utilization in identification by the judging unit 50. In that case, the judging unit 50 judges that a signal is from the vehicle ahead if a received optical signal has a flag and from the optical communication roadside device 20 if the received optical signal has no flag. Thus, by attaching a flag for identification to a vehicle group ID, a signal from the optical communication roadside device 20 and one from a vehicle ahead may be distinguished from each other more reliably. It is also possible to attach an identification flag to a signal from the optical communication roadside device 20 and not to information sent from the information transmitter of the in-vehicle device 40.

Fourth Embodiment

A fourth embodiment is an example where information communication with an ITS roadside device is performed in accordance with attributes of a vehicle as defined in the third embodiment. As the configurations of the traffic information system according to the fourth embodiment and individual devices are the same as the first embodiment, detailed description thereof is omitted.

Figure 13:
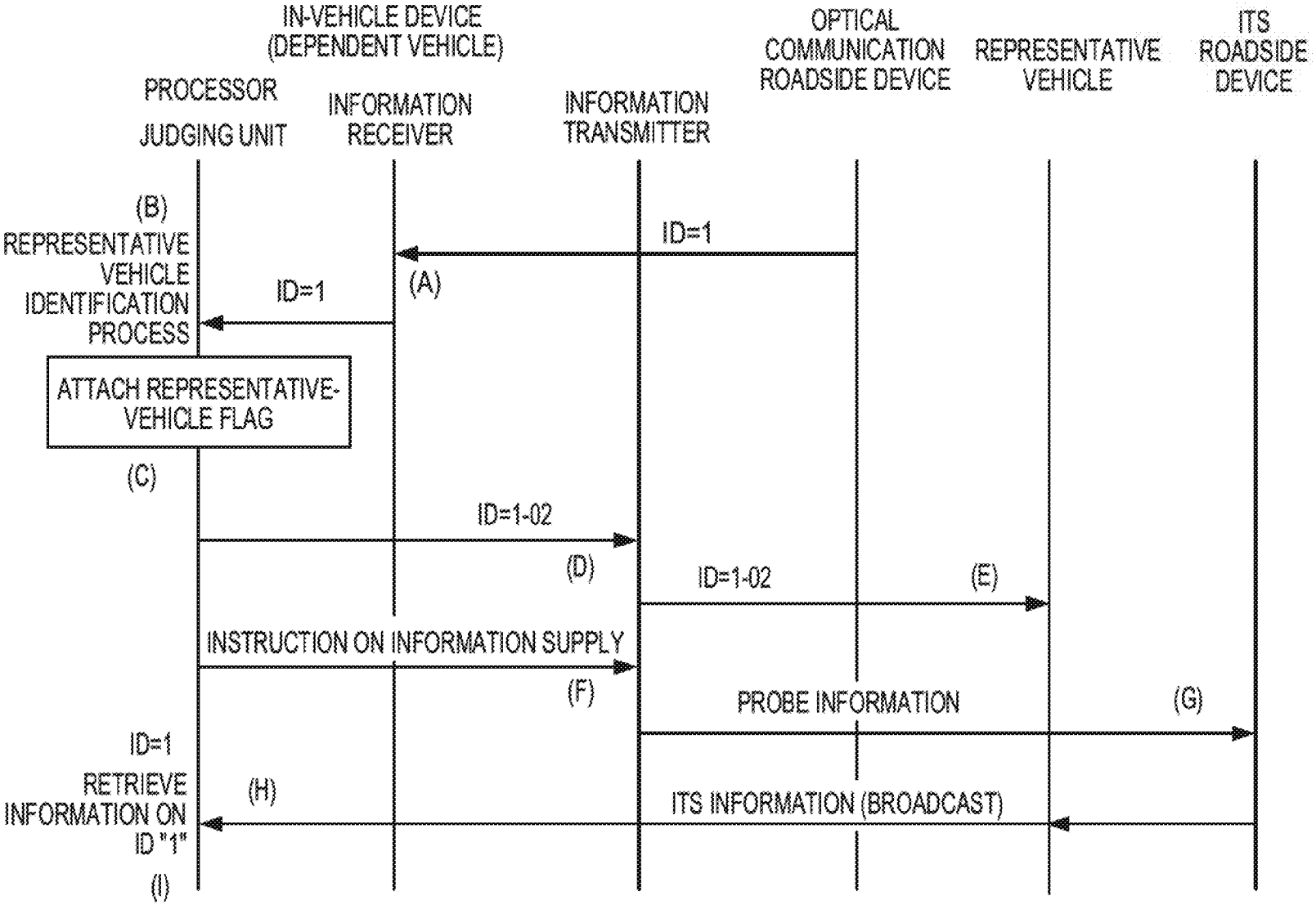
FIG. 13 is a sequence chart illustrating an example of flow of control on a representative vehicle in the traffic information system according to a fourth embodiment.

FIG. 13 is a sequence chart of a control on a representative vehicle in a vehicle group. Information transmission from a representative vehicle is described first. When the information receiver 48 of the in-vehicle device 40 has received information containing a vehicle group ID "1" from the optical communication roadside device 20 (A), the judging unit 50 performs a representative vehicle identification process (B) and judges that the host vehicle thereof is the representative vehicle in the vehicle group having ID "1". Subsequently, the processor 52 attaches a flag indicating that the vehicle is the representative vehicle to the vehicle group ID received (C). As a result, the vehicle group ID becomes "1-02" (the "-02" portion is the flag). The vehicle group ID with the flag attached is sent to the information transmitter 56 (D), from which the vehicle group ID is transmitted to other vehicles (E).

The representative vehicle also collects various types of probe information about itself (e.g., the speed, weather information for its location, and the like) with a sensor not illustrated. In response to an instruction from the processor 52 requesting supply of information (F), the information transmitter 56 transmits collected probe information to the ITS roadside device 60 (G). As described above, the information transmitter 56 transmits probe information about the vehicle to the ITS roadside device 60 when the vehicle has been identified as a representative vehicle.

The information receiver 48 of the in-vehicle device 40 receives traffic information broadcast from the ITS roadside device 60 (H). The judging unit 50 retrieves information about ID "1" which is the vehicle group ID of the vehicle, from the received traffic information (I). The sorting out downlink information here is the same as that described in the second embodiment.

A flag to be attached to a vehicle group ID transmitted from a representative vehicle may be determined according to the traveling position of the vehicle. For example, in the case of a three-lane road, "-01" may be a flag for the representative vehicle when on the left-hand lane, "-02" on the center lane, and "-03" on the right-hand lane. By thus using different flags for individual lanes, more detailed management of a vehicle group becomes possible.

Figure 14:
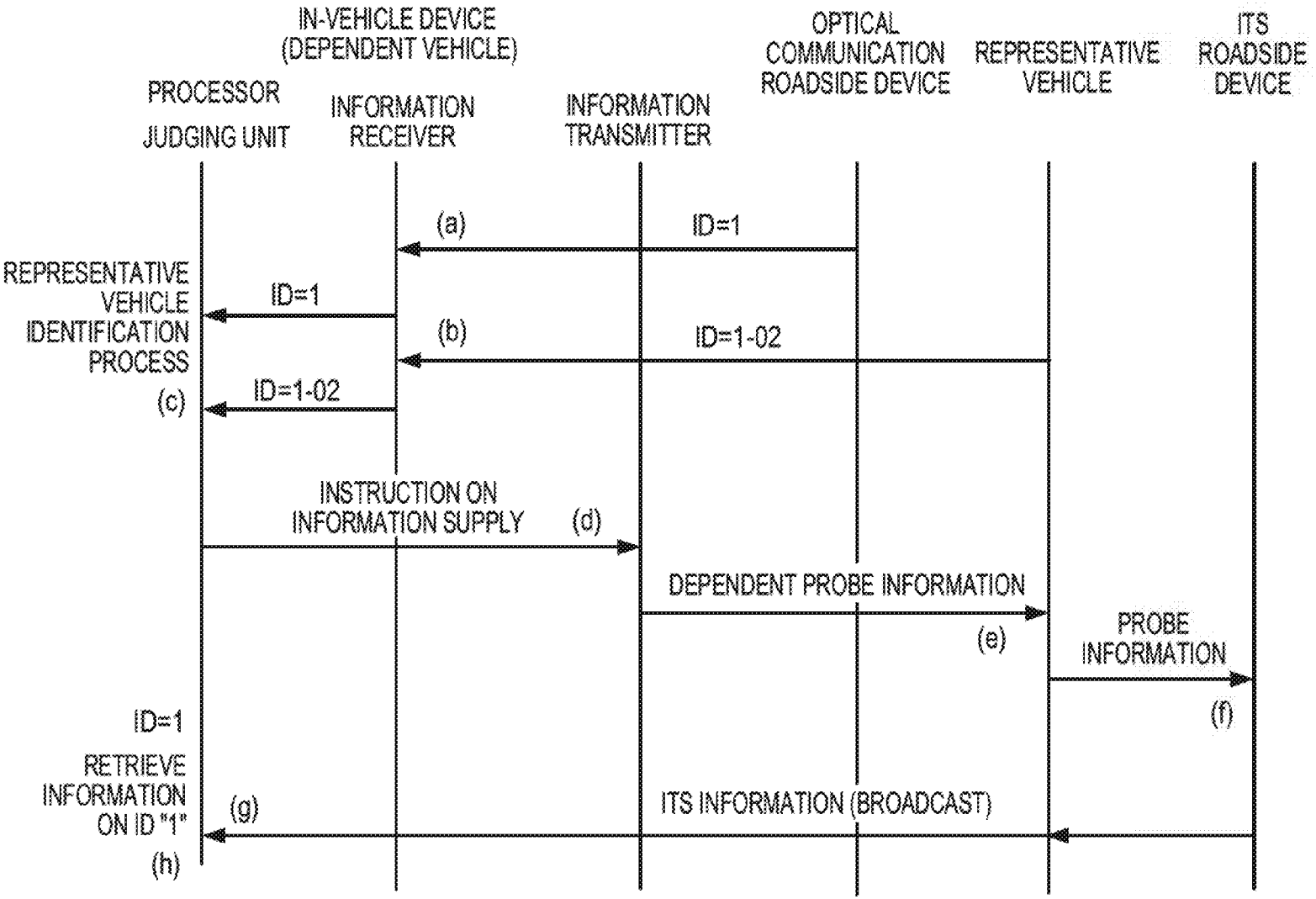
FIG. 14 is an example of flow of control on a dependent vehicle in the traffic information system according to the fourth embodiment.

FIG. 14 is a sequence chart of a control on a dependent vehicle in a vehicle group. Information transmission on uplink is described first. When the information receiver 48 of the in-vehicle device 40 has received information on a vehicle group ID "1" from the optical communication roadside device 20 (a) and also information on a vehicle group ID "1-02" from the vehicle ahead (b), the judging unit 50 performs a representative vehicle identification process (c) and judges that the host vehicle thereof is a dependent vehicle in a vehicle group having ID "1". If that vehicle is identified as a dependent vehicle, the information transmitter 56 does not transmit information to the ITS roadside device 60. Instead, the information transmitter 56 responds to the instruction on information supply from the processor 52 (d) to transmit probe information about the vehicle (dependent probe information) to the representative vehicle (e). The representative vehicle communicates with the ITS roadside device 60 and transmits the probe information collected from the dependent vehicle to the ITS roadside device (f).

The information receiver 48 of the in-vehicle device 40 receives traffic information broadcast from the ITS roadside device 60 (g). The judging unit 50 retrieves information relating to ID "1" which is the vehicle group ID of the host vehicle thereof, from the received traffic information (h). Sorting downlink information here is the same as that performed on the representative vehicle.

As described above, since only a representative vehicle transmits probe information to the ITS roadside device 60 in the information communication system according to the fourth embodiment, bandwidth used for uplink may be reduced. Also, since probe information collected by a dependent vehicle is also transmitted to the ITS roadside device 60 via the representative vehicle, information may be collected more efficiently.

When a vehicle is a dependent vehicle within a vehicle group but is a representative vehicle in a section defined by the optical communication roadside device 20, like the vehicle D in FIG. 12, different vehicle group IDs are preferably used for uplink and downlink. In FIG. 12, the vehicle D is traveling straight into the intersection having the traffic light 10*b* and is expected to continue to travel toward the traffic light 10*a*. Therefore, downlink traffic information necessary for its subsequent travel is preferably obtained using ID "1" (acquisition of traffic information for ID "2" is of no use). On the other hand, as uplink probe information for transmission to the ITS roadside device 60, information about ID "2" which is the section in which the vehicle D has been traveling, is preferably transmitted (because little probe information has been collected for the section of ID "1"). Alternatively, a vehicle that is a dependent vehicle in a vehicle group but is a representative vehicle in a predetermined section, like the vehicle D described above, may send probe information to the ITS roadside device 60.

Fifth Embodiment

A fifth embodiment is an example of control on an isolated vehicle that does not receive a signal from either an optical communication roadside device or a vehicle ahead. For example, the vehicle D in FIG. 1 will cease receiving optical signals from the traffic light 10 due to a right turn. If there is no vehicle ahead of the vehicle D after the right turn, the vehicle D does not receive an optical signal from a vehicle ahead either, thus the judging unit 50 of the in-vehicle device 40 judges that the vehicle D is an isolated vehicle.

It is inconvenient that an isolated vehicle has no vehicle group ID because broadcast information from the ITS roadside device 60 cannot be sorted out according to a vehicle group ID as described in the second embodiment. It is therefore preferable that even an isolated vehicle have a temporary vehicle group ID of some kind until the vehicle receives the next optical signal.

Hereinafter, a case where a vehicle group ID is assigned to a vehicle based on the last optical signal received from an optical communication roadside device will be described. It is assumed that in the fourth embodiment a vehicle group ID is set for each traffic light (or an optical communication roadside device) installed at each intersection. It is also assumed that the information receiver 48 of the in-vehicle device 40 obtains a vehicle group ID from one of such optical communication roadside devices 20.

Figure 15:
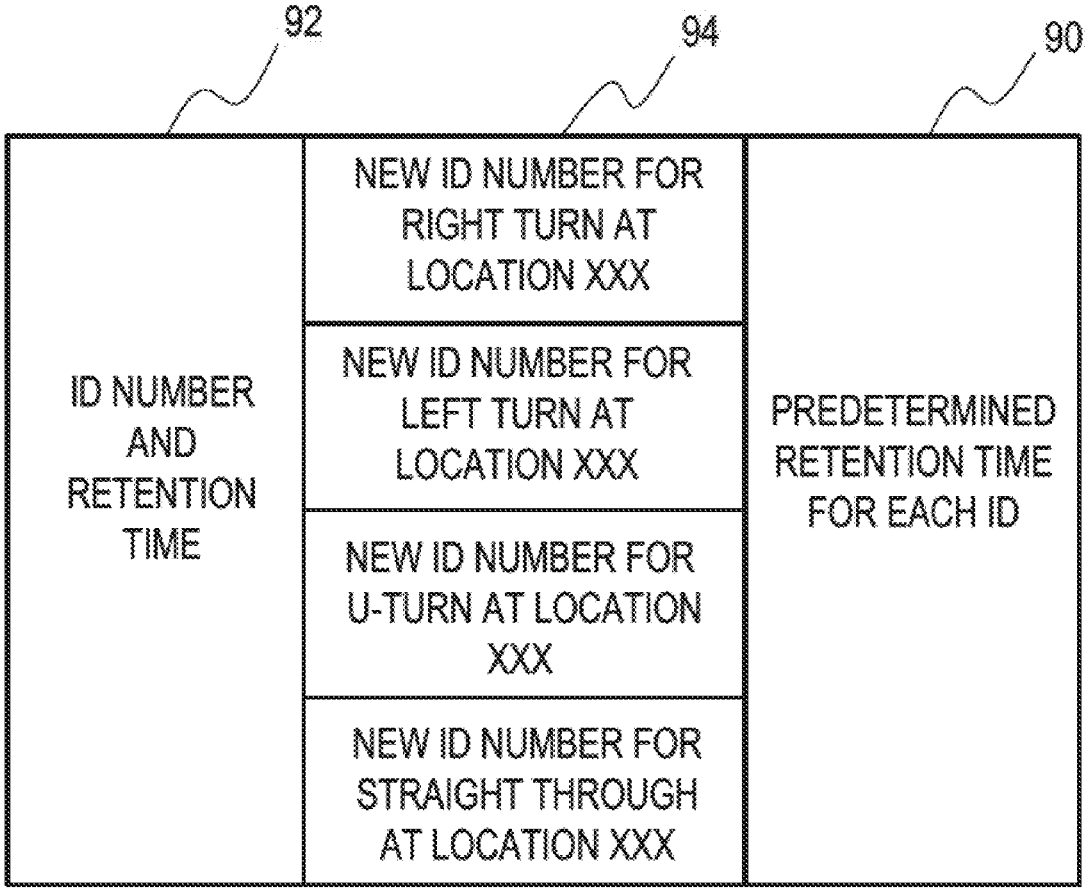
FIG. 15 is an example of a format for a signal that is transmitted and received between an optical communication roadside device according to a fifth embodiment and a vehicle.

FIG. 15 is an example of a signal format used in an optical communication system. In an optical signal transmitted from the optical communication roadside device 20, retention time is set for each vehicle group ID (reference numeral 90). When a predetermined time has elapsed since the last reception of an optical signal containing a vehicle group ID, the vehicle group ID stored in the memory 46 of the in-vehicle device 40 is discarded. The in-vehicle device 40 manages a vehicle group ID and retention time (reference numeral 92). Also, new vehicle group IDs which should be obtained next from the optical communication roadside device 20 are respectively set for various movements of the vehicle, such as right turn, left turn, U-turn, and straight through (reference numeral 94).

In the fifth embodiment, the judging unit 50 of the in-vehicle device 40 functions as a detection unit for detecting a movement of the host vehicle. The judging unit 50 detects an accelerating, braking, or steering operation of the vehicle, for example, and detects an action made by the vehicle (e.g., a right turn, left turn, U-turn, or straight through). The judging unit 50 also functions as a prediction unit for predicting a vehicle group ID that should be obtained next based on a movement of the vehicle detected.

Figure 16:
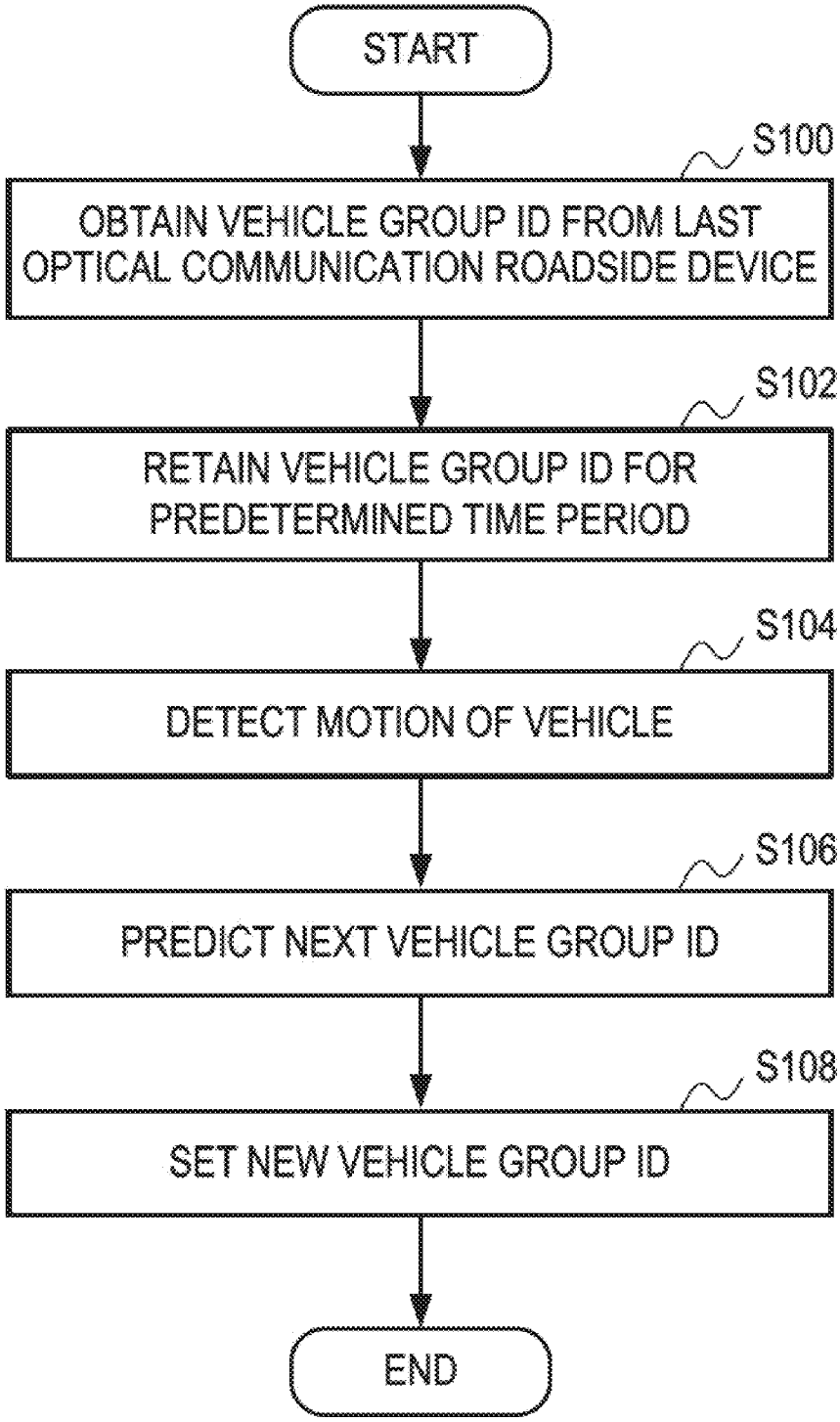
FIG. 16 is a flowchart illustrating an example of control flow by the in-vehicle device 40 according to the fifth embodiment.

FIG. 16 is an example of a flowchart of a control by the in-vehicle device 40 according to the fifth embodiment. First, when the information receiver 48 has received an optical signal from the last optical communication roadside device 20 (step S100), the memory 46 retains a vehicle group ID contained in the optical signal for a predetermined time period (step S102). Then, the judging unit 50 detects a movement of the vehicle using an acceleration sensor or the like not illustrated (step S104), and predicts a vehicle group ID that is expected to be obtained next based on the movement of the vehicle detected, the last vehicle group ID obtained, and map information of intersections including IDs of the intersections (step S106). The judging unit 50 sets the vehicle group ID predicted at step S106 as the vehicle group ID of the host vehicle thereof (step S108). At this point, the vehicle group ID that was last obtained from the optical communication roadside device 20 is discarded.

For example, it is assumed that, in FIG. 1, after vehicle D makes a right turn at the intersection having ID "001" the vehicle D will reach an intersection having ID "009" next. In this case, the judging unit 50 predicts that the vehicle group ID that should be obtained next is ID "009" based on the position information for the intersection at which the vehicle D is now positioned (i.e., ID "001") and the right-turn operation of the vehicle.

The in-vehicle device 40 of the fourth embodiment maintains the last vehicle group ID received for a predetermined time period if the vehicle does not receive an optical signal from either the optical communication roadside device 20 or a vehicle ahead. Possession of a temporary vehicle group ID may help sorting out broadcast information sent from the ITS roadside device 60 or the like. Also, by predicting a vehicle group ID that should be obtained next based on the last vehicle group ID received and an operation of the vehicle, it is possible to set a temporary vehicle group ID of higher accuracy.

According to the in-vehicle apparatus, roadside device, and traffic information system described above, since the first roadside device and the in-vehicle apparatus define a vehicle group using identification information, a vehicle group may be managed in a simpler manner.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An in-vehicle apparatus, comprising:

a first receiver to receive first group identification information about a vehicle group that is transmitted from a first roadside device by a signal having directivity and to receive second group identification information from a transmitter of another vehicle;

a judging unit to identify the vehicle group to which a host vehicle of the in-vehicle apparatus belongs based on at least one of the first group and the second group identification information; and a second transmitter to transmit identification information of the identified vehicle group rearward from the vehicle by a signal having directivity, wherein the first receiver receives the second group identification information transmitted from the second transmitter of a vehicle ahead, and the judging unit judges that the host vehicle thereof is a representative vehicle of a vehicle group if the first receiver receives first group identification information from the first roadside device and does not receive the second group identification information from the vehicle ahead.

2. The in-vehicle apparatus according to claim 1, further comprising:

a second receiver to receive information transmitted from the second roadside device; and a selection unit to select relevant information from the information received by the second receiver based on the identified vehicle group.

3. The in-vehicle apparatus according to claim 1, wherein the first transmitter transmits information about the host vehicle of the first transmitter to the second roadside device if the judging unit judges that the host vehicle is the representative vehicle.

4. The in-vehicle apparatus according to claim 1, wherein the judging unit judges that the host vehicle thereof is a dependent vehicle in a vehicle group if the receiver receives both first group identification information from the first roadside device and the second group identification information from the vehicle ahead and the first group identification information and the second group identification information match.

5. The in-vehicle apparatus according to claim 4, wherein the first transmitter does not transmit information about the host vehicle of the first transmitter to the second roadside device if the judging unit judges that the host vehicle is the dependent vehicle.

6. The in-vehicle apparatus according to claim 4, wherein the judging unit judges that the host vehicle thereof is a representative vehicle in a predetermined section defined by the first roadside device if the first group identification information and the second group identification information do not agree with each other.

7. The in-vehicle apparatus according to claim 6, wherein the first transmitter transmits information about the host vehicle of the first transmitter to the second roadside device if the judging unit judges that the host vehicle is the representative vehicle of the predetermined section.

8. The in-vehicle apparatus according to claim 1, wherein the first receiver receives a signal transmitted from one of a plurality of the first roadside devices, and the in-vehicle apparatus further comprises a retention unit to retain a last identification information received from the first roadside device for a predetermined time period.

9. The in-vehicle apparatus according to claim 8, further comprising:

a detection unit to detect a movement of the host vehicle of the in-vehicle apparatus; and a prediction unit to predict identification information from the first roadside device that is to be received next by the first receiver based on the movement of the host vehicle of the in-vehicle apparatus detected by the detection unit and identification information retained in the retention unit for the predetermined time period.

10. A traffic information system, comprising:

a first roadside device comprising a transmitter to transmit first group identification information about a vehicle group to a vehicle in a signal having directivity;

an in-vehicle apparatus comprising a receiver to receive the first group identification information from the first roadside device and to receive second group identification of a vehicle group from a transmitter of another vehicle, and a judging unit to identify a vehicle group to which a host vehicle of the in-vehicle apparatus belongs based on at least one of the first group identification information and the second group identification; and a second transmitter to transmit identification information of the identified vehicle group rearward from the vehicle by a signal having directivity, wherein the first receiver receives the second group identification information transmitted from the second transmitter of a vehicle ahead, and the judging unit judges that the host vehicle thereof is a representative vehicle of a vehicle group if the first receiver receives first group identification information from the first roadside device and does not receive the second group identification information from the vehicle ahead.

11. The traffic information system according to claim 10, wherein the in-vehicle apparatus further comprises a transmitter to transmit the group information of the identified vehicle group to a roadside device other than the first roadside device; and the traffic information system further comprises a second roadside device comprising a receiver to receive the identification information transmitted from the transmitter of the in-vehicle apparatus and being connected to a network of a road traffic system.

12. The in-vehicle apparatus according to claim 1, further comprising:

a first transmitter to transmit the group identification information of the identified vehicle group to a second roadside device connected to a network of a road traffic system.

* * * * *